US008920030B2

(12) United States Patent
McSweeney et al.

(10) Patent No.: US 8,920,030 B2
(45) Date of Patent: Dec. 30, 2014

(54) FLEXIBLE PACKAGE WITH ACCESS CONTROL FEATURE

(75) Inventors: Anne Margaret McSweeney, Hershey, PA (US); Marcus R. Plato, Palmyra, PA (US)

(73) Assignee: The Hershey Company, Hershey, PA (US)

( * ) Notice: Subject to any disclaimer, the term of this patent is extended or adjusted under 35 U.S.C. 154(b) by 376 days.

(21) Appl. No.: 13/069,770

(22) Filed: Mar. 23, 2011

(65) Prior Publication Data

US 2012/0243809 A1 Sep. 27, 2012

(51) Int. Cl.
*B65D 33/30* (2006.01)

(52) U.S. Cl.
CPC ..... *B65D 33/30* (2013.01); *Y10S 383/905* (2013.01)
USPC ..... 383/207; 383/42; 383/88; 383/89; 383/905

(58) Field of Classification Search
CPC ..... B65D 27/26; B65D 33/30; B65D 33/32; Y10S 383/905
USPC ..... 383/78, 81–86, 88–91, 905, 33, 43
See application file for complete search history.

(56) References Cited

U.S. PATENT DOCUMENTS

| | | | | |
|---|---|---|---|---|
| 3,150,813 | A | 9/1964 | Wellman | |
| 3,278,085 | A * | 10/1966 | Brown | 222/107 |
| 3,330,469 | A * | 7/1967 | Koncak | 383/94 |
| 3,353,662 | A * | 11/1967 | Pickin | 206/390 |
| 3,556,292 | A * | 1/1971 | Krzyzanowski | 206/464 |
| 3,618,850 | A * | 11/1971 | Palmer | 383/204 |
| 3,764,060 | A * | 10/1973 | Ruda | 206/459.5 |
| 3,859,895 | A | 1/1975 | White | |
| 3,889,871 | A | 6/1975 | White | |
| 4,051,994 | A | 10/1977 | Donk et al. | |
| 4,394,955 | A * | 7/1983 | Raines et al. | 383/86 |
| 4,936,817 | A * | 6/1990 | Runge | 493/213 |
| 5,037,138 | A * | 8/1991 | McClintock et al. | 383/34 |
| 5,674,010 | A * | 10/1997 | Dussich | 383/70 |
| 6,238,090 | B1 * | 5/2001 | Yuter | 383/2 |
| 7,665,895 | B2 | 2/2010 | Takita et al. | |
| 2004/0031195 | A1 * | 2/2004 | Weder | 47/72 |
| 2008/0000200 | A1 * | 1/2008 | Dierl et al. | 53/412 |
| 2011/0211773 | A1 * | 9/2011 | Romeo et al. | 383/2 |

FOREIGN PATENT DOCUMENTS

| | | | |
|---|---|---|---|
| DE | 3829181 | A1 | 8/1988 |
| DE | 4117428 | A1 | 5/1991 |
| DE | 4233509 | A1 | 10/1992 |
| DE | 29923287 | U1 | 9/2000 |
| EP | 1627729 | A1 | 8/2005 |

* cited by examiner

*Primary Examiner* — Jes F Pascua
*Assistant Examiner* — Nina Attel
(74) *Attorney, Agent, or Firm* — McNees Wallace & Nurick LLC

(57) ABSTRACT

Exemplary embodiments are directed to flexible packages having an access control feature in the form of a strip of a malleable sheet material that can be used to form a dead fold to re-close an opened package and prevent spilling. The access control feature can also be used to keep the mouth of the package open for easier access when the contents of the package are being consumed. Exemplary embodiments operate in an intuitive manner and are easy to use. The access control feature provides a tactile cue to the user for properly closing the package, as well as visual assurance that the package has been closed.

17 Claims, 8 Drawing Sheets

FLEXIBLE PACKAGE WITH ACCESS CONTROL FEATURE

FIELD

This application is directed to flexible packaging and more particularly to flexible bags and other packages having a feature for controlling access to the package and its contents.

BACKGROUND

Candy and other food products are often packaged in bulk and consumed incrementally over time. Consumers prefer such packages be closed when not being actively consumed to maintain freshness, encourage portion control, and to prevent accidental spillage during handling and/or storage. In some cases, the reclosure of a package may be achieved by the use of a separate clip provided by the consumer and affixed to the bag. Zipper closures incorporated directly in the package are also commonly used as a reclosure feature.

Among the drawbacks of current package reclosure features are that the consumer often does not consider the need for a clip until after the bag is open. The consumer then must search for the clip among a drawer full of odds and ends while trying not to spill the contents of the now-opened package. Zipper closures formed as part of the package can be slightly more handy, but are expensive to produce. Zipper closures also present consumers difficulties in the visual or palpable determination whether a proper closure has been achieved until after the packages is in a position that would result in spillage if the zipper was not properly closed.

Furthermore, current reclosure features are provided to achieve only that limited purpose. They do not act as a true access control feature that can also aid in keeping the package open when its contents are desired to be consumed.

These and other drawbacks are found in current product packaging.

SUMMARY

Exemplary embodiments are directed to flexible packaging that contains an access control feature for reclosing the packaging in a robust, repeatable manner that provides a readily identifiable way for a consumer to conclude the package is safely closed. In certain embodiments, the access control feature further assists in keeping the package open for easy access where, for example, repeated servings are likely to occur in short succession. Exemplary embodiments employ one or more strips formed of a malleable sheet of material capable of maintaining a dead fold incorporated into the package.

According to an embodiment, a flexible package comprises a first package side wall having an external surface and an internal surface; a second package side wall having an external surface and an internal surface, the second package side wall opposing the first package side wall such that the internal surfaces of the first and second package side walls face toward one another; and a strip of a malleable sheet material attached to the first package side wall. An edge portion of the first package side wall is sealed to an edge portion of the second package side wall to form a seam, the first package side wall and the second package side wall further forming a mouth of the package.

According to another embodiment, a flexible package comprises a first package side wall having an external surface and an internal surface; a second package side wall having an external surface and an internal surface, the second package side wall opposing the first package side wall such that the internal surfaces of the first and second package side walls face toward one another; and a strip of metallic foil attached to the first package side wall, extending from a first edge of the first package side wall to a second edge of the first package side wall. An edge portion of the first package side wall is sealed to an edge portion of the second package side wall to form a seam, the first package side wall and the second package side wall further forming a mouth of the package and the strip of metallic foil is oriented substantially horizontally with respect to the mouth of the packaging, the strip of metallic foil having a fold guide formed therein comprising a score extending linearly across the strip of the metallic foil.

According yet another embodiment, a flexible package comprises a first package side wall having an external surface and an internal surface; a second package side wall having an external surface and an internal surface, the second package side wall opposing the first package side wall such that the internal surfaces of the first and second package side walls face toward one another; and a strip of metallic foil attached to the first package side wall and extending from a first edge of the first package side wall to a second edge of the first package side wall. An edge portion of the first package side wall is sealed to an edge portion of the second package side wall to form a seam, the first package side wall and the second package side wall further forming a mouth of the package. The strip of the metallic foil is oriented substantially vertically with respect to the mouth of the packaging, the strip of metallic foil having a plurality of fold guides formed therein, each fold guide comprising a score extending linearly along the width of the strip of metallic foil, whereby the fold guides are oriented substantially horizontally with the mouth of the packaging.

In one embodiment, a flexible package comprises a first package side wall having an external surface and an internal surface; a second package side wall having an external surface and an internal surface, the second package side wall opposing the first package side wall such that the internal surfaces of the first and second package side walls face toward one another; and a strip of a polymer coated metallic foil heat sealed to a surface of the first package side wall, the foil extending from a first edge of the first package side wall to a second edge of the first package side wall, the foil having a thickness in the range of about 0.003 inches to about 0.005 inches. An edge portion of the first package side wall is sealed to an edge portion of the second package side wall to form a seam, the first package side wall and the second package side wall further forming a mouth of the package. The strip of foil is oriented substantially horizontally with respect to the mouth of the package, the foil having a fold guide formed therein comprising a score extending linearly substantially parallel to the mouth of the package.

An advantage is that a flexible package is provided that is easy to close and operates in an intuitive manner, while providing visual assurance that the package has been closed.

Another advantage is that incorporation of a fold guide into the strip of the malleable sheet material provides a tactile cue to the user for properly closing the package.

Yet another advantage is that the use of the strip of malleable sheet material can also be used to maintain the mouth of the package open for easier access to its contents.

Still another advantage is that exemplary embodiments of the invention may be less expensive to produce than packages with zipper style closures, while still providing an integrated closure feature.

Other features and advantages of the present invention will be apparent from the following more detailed description of exemplary embodiments, taken in conjunction with the accompanying drawings which illustrate, by way of example, the principles of the invention.

DETAILED DESCRIPTION OF EXEMPLARY EMBODIMENTS

Exemplary embodiments are directed to flexible packages having an access control feature provided by a strip of a malleable sheet material that can be used to form a dead fold to re-close an opened package and prevent spilling. Flexible packaging does not become damaged, dented, or torn when transported by the consumer in things such as purses, backpacks, and the like. Flexible packaging conforms to shapes such as cup holders. The access control feature can also be used to keep the mouth of the package open for easier access when the contents of the package are being consumed. Exemplary embodiments operate in an intuitive manner and are easy to use. The access control feature provides a tactile cue to the user for properly closing the package, as well as visual assurance that the package has been closed.

Figure 1:
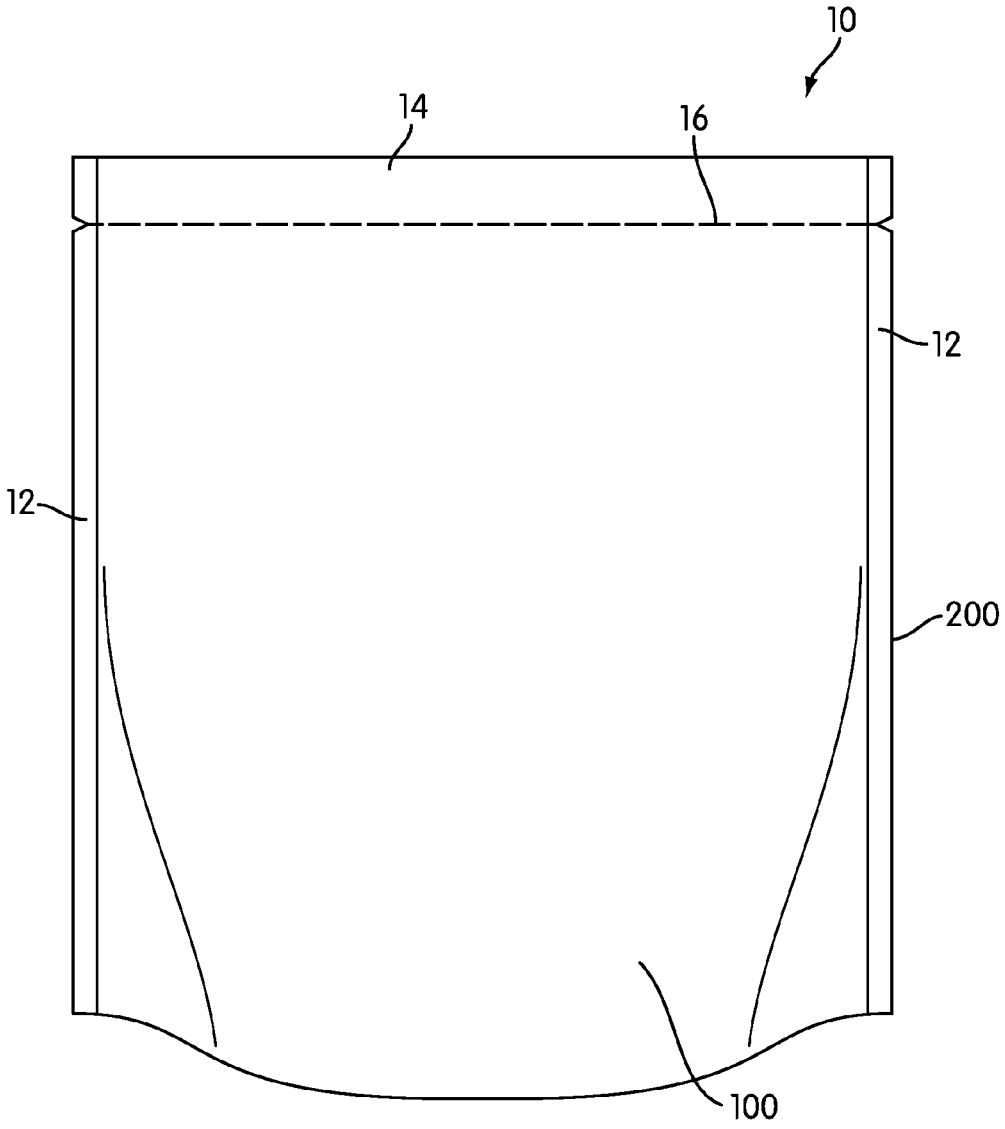
FIG. 1 illustrates a flexible package in accordance with an exemplary embodiment.

FIG. 1 illustrates a flexible package 10 in accordance with an exemplary embodiment. The package 10 includes a first package side wall 100 and a second package sidewall 200. Each of the first and second package side walls 100, 200 has an internal and external surface, with the internal surfaces of the side walls facing one another, the side walls 100, 200 being in substantial registration with one another to form the basic shape of the package 10. At least a portion of the edges of the side walls 100, 200 are heat sealed or otherwise attached to one another to form seams 12. The seams 12 form at least a partial perimeter around the sides and top to create the enclosure formed by the package 10. The package 10 may include a laser score 16, notch and/or other tear-aid formed therein to assist a consumer in achieving an easy, clean tear in removing a top seam 14 to open the package 10 and gain access to its contents.

Depending on the style of the package, the seams 12 formed by the first and second side walls 100, 200 may extend around the entire perimeter of the package 10. As better seen in an unassembled view shown in FIG. 8, the flexible package 10 of FIGS. 1 through 4 is a gusset bag that further includes a common bottom portion 13 attached to each of the side walls 100, 200 so that the package can be created using two side seams formed by sealing together edge portions 11 of the respective side walls 100, 200, along with a top seam. Exemplary embodiments of the invention may be employed with a variety of different styles of flexible packaging including gusset bags (side gusset and bottom gusset) and pillow bags, by way of example.

Any flexible film materials useful in the art for constructing flexible packages can be used in accordance with exemplary embodiments. These include single and multi-layer polymer film materials, paper or cellulosic materials (which may optionally be coated with one or more polymeric films), as well as other ecologically friendly composites.

Figure 2:
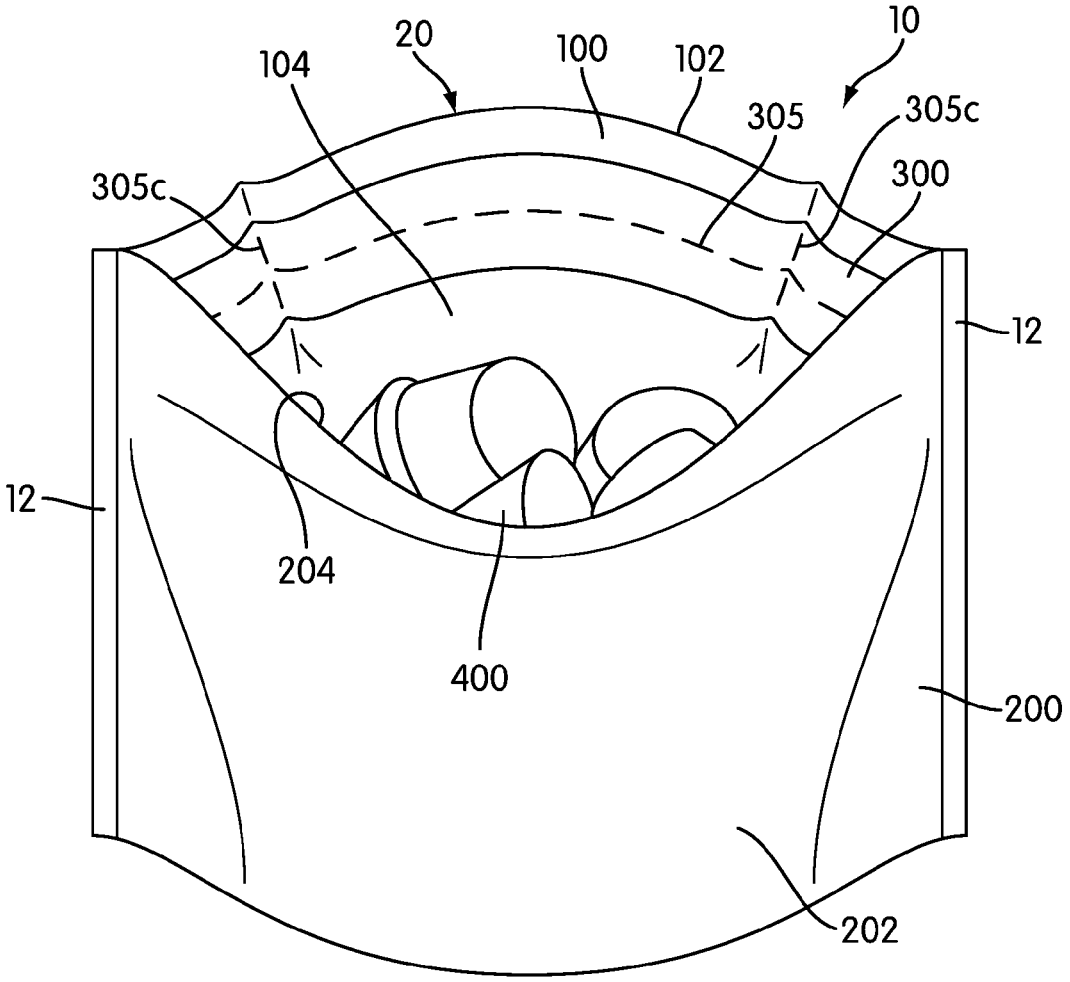
FIG. 2 illustrates a view of the package shown in FIG. 1 after opening.

Turning to FIG. 2, a view through the mouth 20 of the package 10 into the internal portion is shown after the consumer has opened it to reveal the contents 400, which may be pieces of candy, nuts or anything else desired to be contained with the package 10. A strip 300 of a malleable sheet material is attached to the internal surface 104 of the first side wall 100. Optionally, the strip 300 may instead be attached to the first side wall's external surface 102. In some embodiments two strips may be used and separately attached to each of the internal and external surface respectively. In yet another embodiment, the strip may be incorporated within a multi-layer sidewall. In whatever manner the strip 300 is attached to the first side wall 100, the strip 300 provides an access control feature to the package 10 that enables the subsequent re-closure of the package 10 and can further maintain the mouth 20 of the package 10 open while the contents are being consumed.

The strip 300 may be formed of any malleable sheet material such that the strip 300 is capable of forming a crease and retaining a dead fold that resists spring-back from the flexible package material. The strip 300 is typically, but not necessarily, a metallic foil. Exemplary foils include aluminum foil (including foils of elemental aluminum as well as aluminum alloys) and tinfoil (again including foils of both elemental and alloyed tin). Other suitable materials for the strip 300 may include polymeric films (metalized or unmetalized) or paper based materials, by way of example only.

The strip 300 is attached to the first side wall 100 by any suitable method of adhering the two structures. In one embodiment, the strip 300 of malleable sheet material is heat sealed to the first side wall 100. In order to accomplish the heat seal, in embodiments in which the strip 300 is a metallic foil, the foil may be coated with a thin film of polyethylene or other material compatible for heat sealing with the material used to form the first and second side walls 100, 200, so that the foil's film coating bonds to the side wall 100 during heat sealing.

In certain embodiments, a portion of the strip 300 extends into the seam 12 formed when the first and second side walls 100, 200 are heat sealed to one another. As a result, foil strips 300 may be coated on both sides with a thin film of polymeric material for heat sealing to each of the first and second side walls 100, 200.

Figure 3:
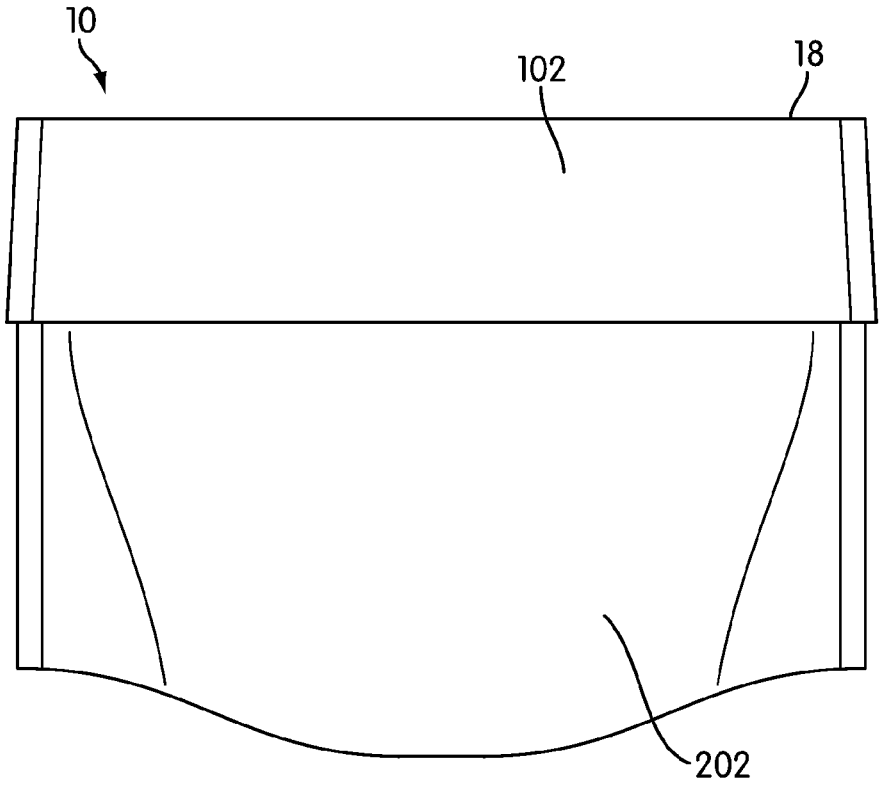
FIG. 3 illustrates the package shown in FIG. 2 after re-closure.

In any case, incorporating the strip 300 of malleable sheet material into the package 10 provides an intuitive, easy way for the package 10 to be re-closed in a secure manner. As shown in FIG. 3, a crease 18 can be formed in the strip 300 (and thus the package 10) by folding the package 10 over in the region of the strip 300 so that the external surface 102 at the top of the first side wall 100 is on the same side of the package 10 as the external surface 202 of the second side wall 200. Although the package 10 can be folded in either direction, better results can be achieved where the side wall of the package 10 that includes the strip 300 is folded over the side wall of the package that does not include the strip 300, if a strip 300 is provided on only one side wall. In a similar manner, the strip 300 provides access control that can also be used to keep the package in its open position, by forcing the mouth open by pulling the sidewalls from one another at the mouth, causing the strip 300 to take and temporarily retain an arc-like shape, as seen in FIG. 2, until a subsequent force is applied to close and fold the package 10. In some embodiments, indicia may be printed on the package 10 that aids the consumer in using the strip 300 to close and/or open the package 10.

Generally, it has been determined that the strip 300 should be positioned so that the nearest edge of the strip is at least about 0.375 in. from the mouth 20 of the opened package 10. Furthermore, when the strip 300 is formed of a foil, it has been determined that the strip 300 should generally have a thickness in the range of about 0.0025 inches to about 0.005 inches, typically about 0.003 to about 0.0045 inches, preferably about 0.004 inches. The width may be in the range of about 15 mm to about 75 mm, typically in the range of about 20 mm to about 30 mm. It will be appreciated however, that the dimensions of the strip 300 may further depend on the type and thickness of the flexible materials employed for the side walls 100, 200, as well as the style of package employed, in order to achieve a crease that provides a secure dead fold and resists spring-back of the side walls 100, 200.

A fold guide 305 is formed in the strip 300 that aids in the re-closure of the package 10 and in forming the crease 18. The fold guide 305 provides a pre-determined breakpoint in the strip 300 for forming the crease 18 so that the crease 18 tends to follow a predetermined orientation consistent with the breakpoint in a predictable, repeatable manner. Because the fold guide 305 results in the crease 18 forming in a predetermined manner, it provides a consumer with a tactile cue in how to close the bag, even if the consumer initially starts to fold above or below the breakpoint. The force applied by the consumer causes the crease 18 to start forming along the fold line 305, such that the consumer has a tendency to intuitively change hand position to follow the fold line 305 and obtain the correct fold to get the intended crease 18, even if the initial fold started off incorrectly.

Figure 9:
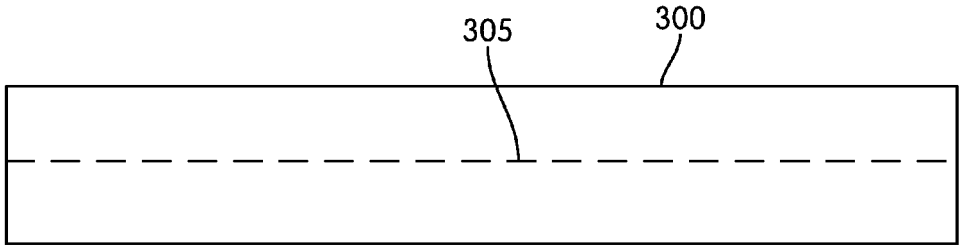
FIGS. 9 through 13 illustrate exemplary different types of fold guides that may be used in conjunction with embodiments of the invention.

The position and orientation of the strip 300 with respect to the mouth 20 of the package 10, as well as the type and orientation of the fold guide 305, may vary depending on the particular type or style of package to be employed. Still referring to the embodiment shown in FIGS. 1 through 3, the strip 300 is oriented substantially horizontally with the mouth 20 of the package 10, in which the fold guide 305 is a score that extends linearly across the strip 300 (seen better in FIG. 9) in form of a series of perforations, such that the fold guide 305 is oriented substantially horizontally with the length dimension of the strip 300. It will be appreciated that any suitable manner of providing a fold guide 305 may be employed, including any method of scoring (including laser scoring, tool scoring, and cutting, for example) as well as by embossing, etching or die cutting, all by way of example.

Figure 7:
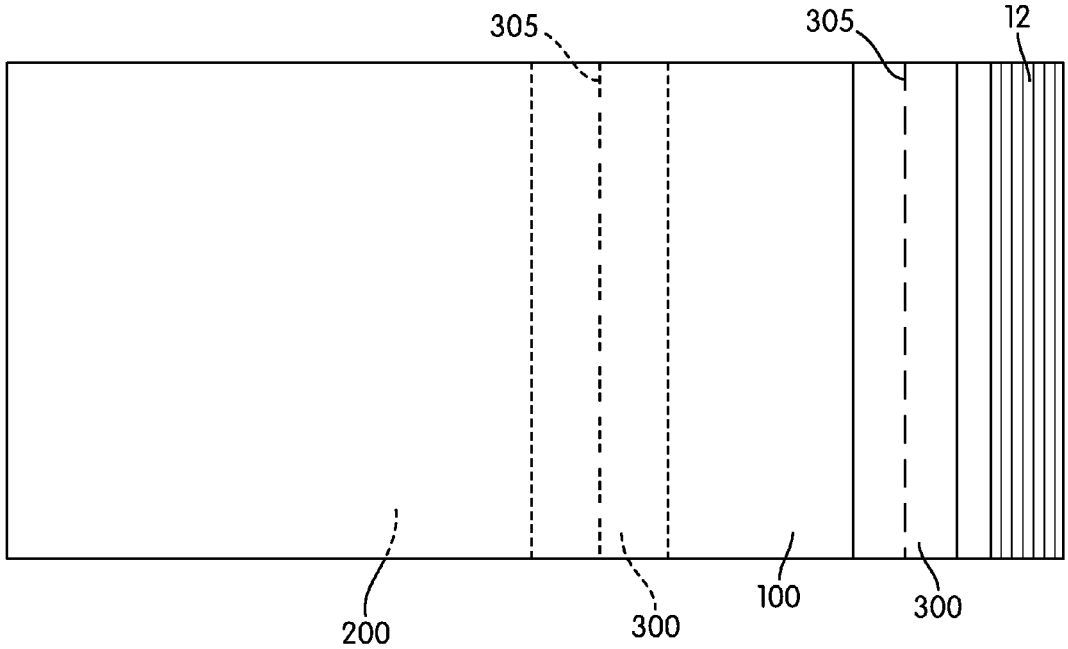
FIG. 7 illustrates a flexible package in accordance with still another exemplary embodiment.
Figure 8:
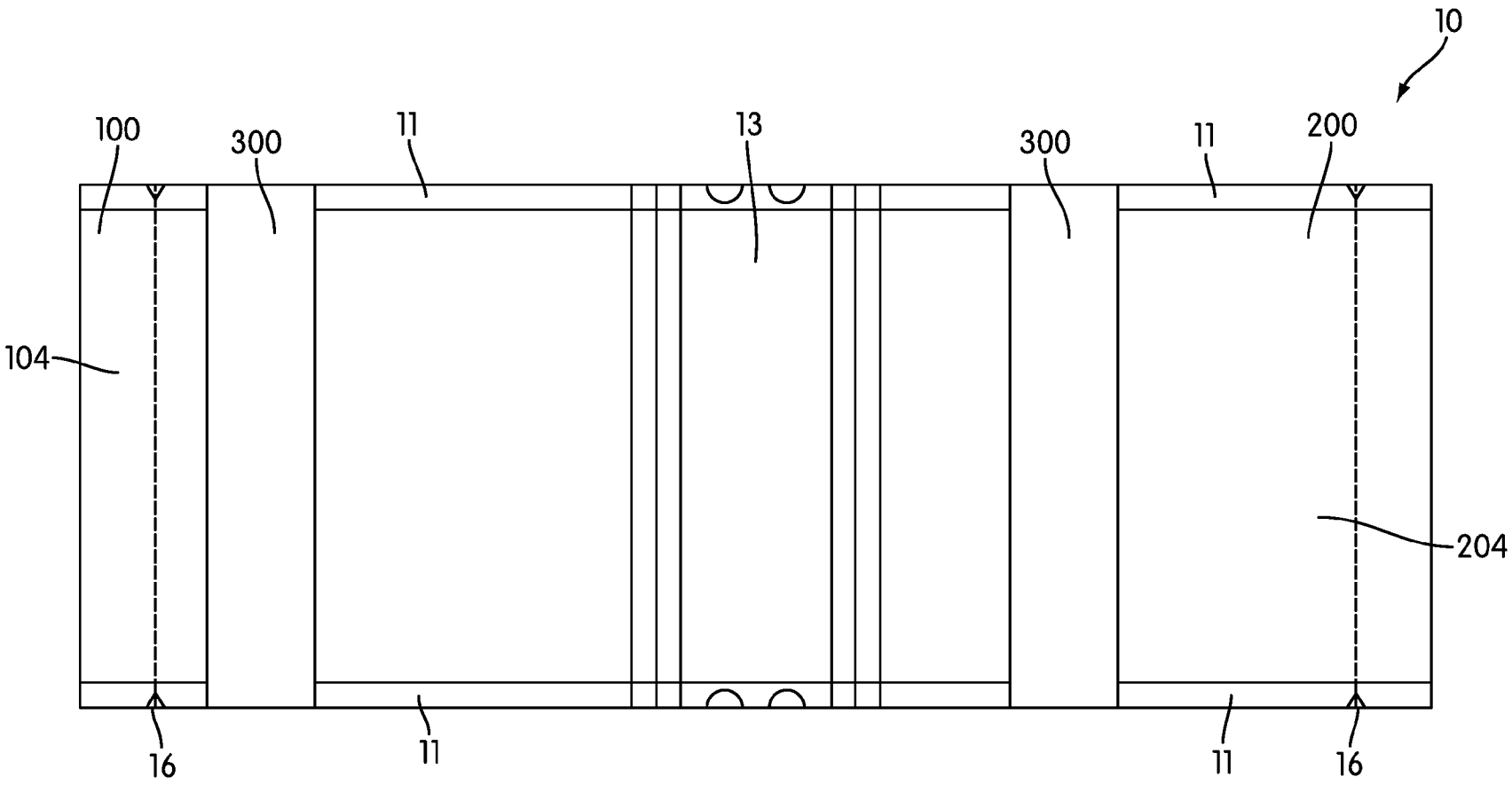
FIG. 8 illustrates an unassembled view of a gusset back in accordance with an exemplary embodiment.
Figure 10:
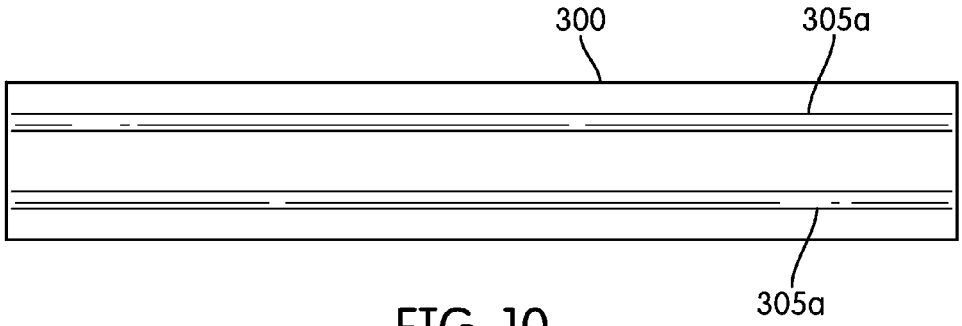

Multiple fold guides 305 may be formed in a single strip 300 to provide multiple creases where, for example, it may be desirable to fold the package over itself to obtain a more secure closure. FIG. 10 illustrates a strip 300 of malleable sheet material having two fold guides 305*a* formed as slightly raised scores extending linearly across the strip 300. Alternatively or in addition, in certain embodiments it may be desirable to provide a plurality of strips across the length of the bag as shown in FIG. 7. In this manner, as the contents are consumed, the consumer can select the appropriate strip to form a crease 18 that closes the package 10 near to the remaining package contents. FIG. 7 also illustrates that the package 10 may employ strips 300 on both the first and second sides 100, 200 of the bag, and that if strips are employed on opposite sides of the bag that they may be offset from one another, as also illustrated in FIG. 8.

Figure 11:
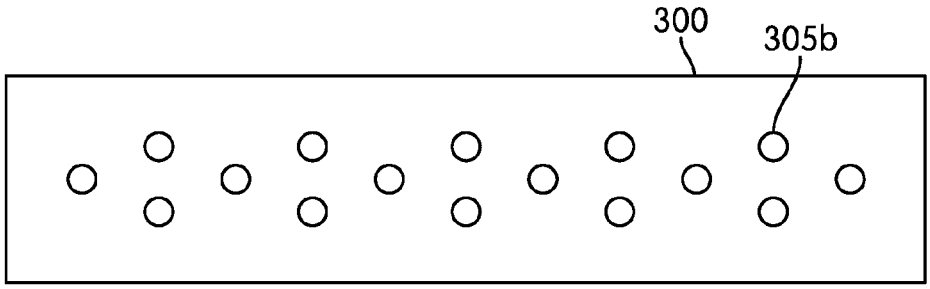

FIG. 11 illustrates an embodiment in which the fold guide 305 is formed by die cutting using a plurality of apertures 305*b*. The apertures 305*b* provide a plurality of points so that multiple predetermined breakpoints can be formed in any one or a combination of a vertical, horizontal, or angled directions that form a line along two or more points.

Figure 4:
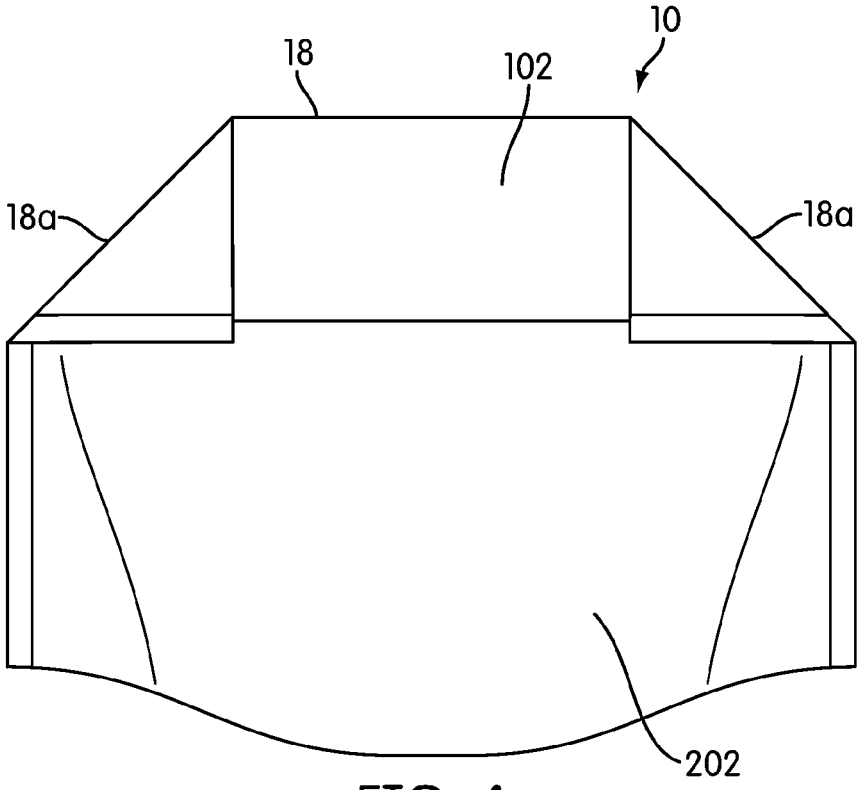
FIG. 4 illustrates an alternative embodiment of the package shown in FIG. 2 after re-closure.
Figure 12:
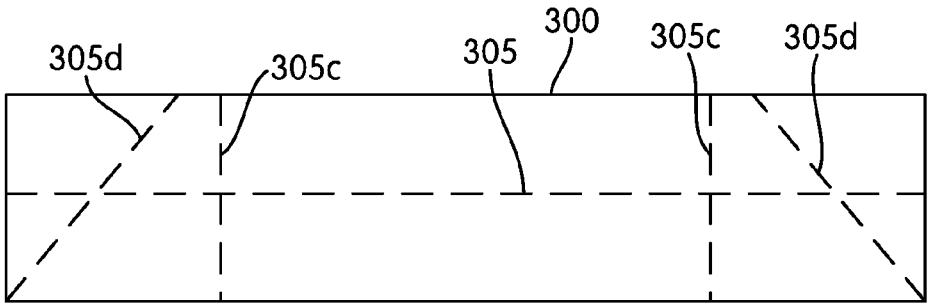

In some embodiments, as illustrated in FIG. 4, it may be desirable to provide folds in multiple directions, creating a second crease 18*a* in a different orientation that that of the primary crease 18. This may further secure the package 10 in its closed position and reduce the possibility that it will unintentionally return to an open position during handling or storage. One manner in which that can be achieved is to provide angled fold guides 305*d* as shown in FIG. 12 that illustrates the use of angled scores in cooperation with the score that extend linearly across the strip to form the primary fold guide 305. FIG. 12 further illustrates that one or more fold guides 305*c* can be arranged to extend vertically across the strip 300. When the strip 300 is attached to the package 10 horizontally with respect to the mouth 20, the vertically disposed fold guides 305*c* can be used to provide structural support to maintain the mouth 20 of the package 10 open as shown in FIG. 2.

Figure 5:
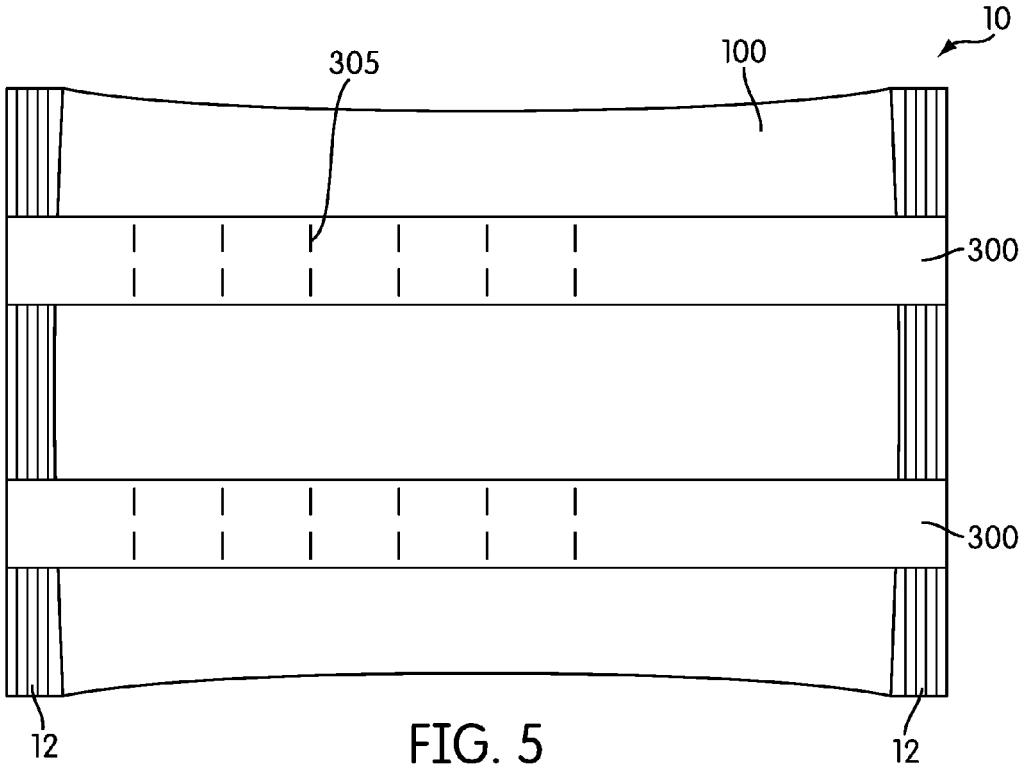
FIG. 5 illustrates a flexible package in accordance with another exemplary embodiment.
Figure 6:
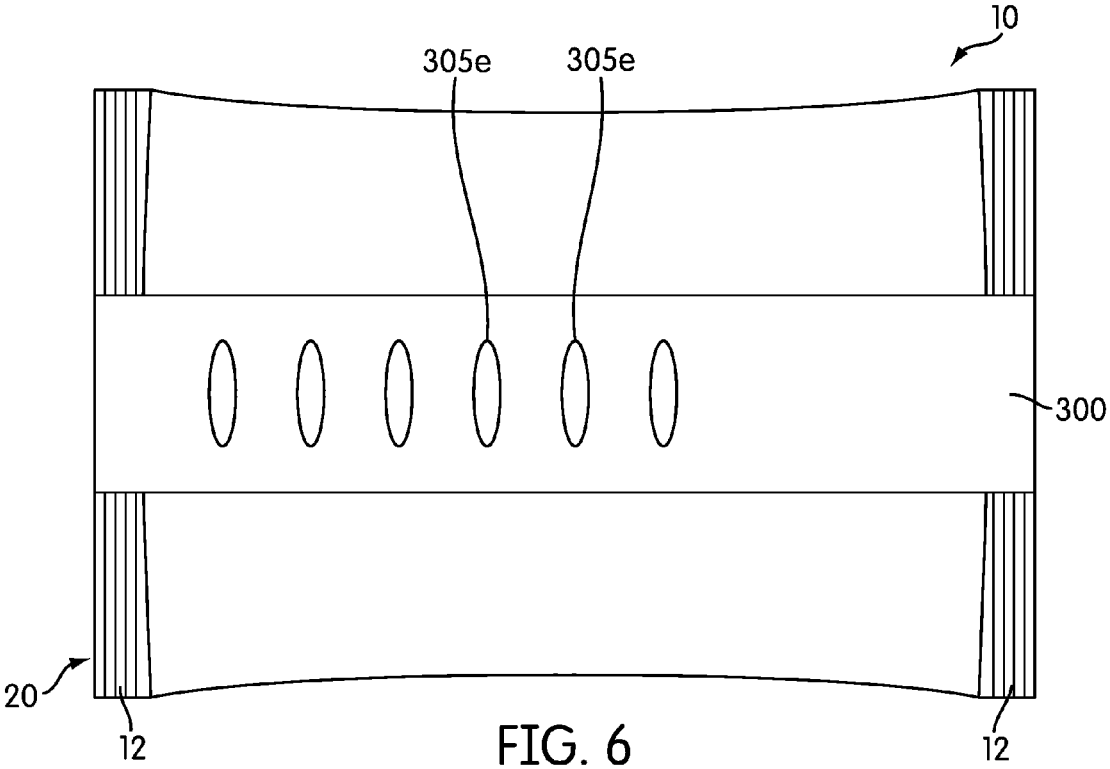
FIG. 6 illustrates a flexible package in accordance with yet another exemplary embodiment.

It will be appreciated that the manner in which the fold guides 305 assist in opening or closing the package 10 depends in part on the orientation of the strip 300 itself with respect to the mouth 20 of the package 10. Turning to FIGS. 5 and 6, a pillow style bag is illustrated in which seams 12 may be formed at the top and bottom of the package 10, with the package typically being opened at one of the seams by pulling the sidewalls away from one another in the conventional manner. FIG. 5 shows a package 10 having a plurality of strips 300 oriented vertically, such that the crease 18 is formed by folding along fold guides 305 that are arranged transverse with respect to the strip 300.

Figure 13:
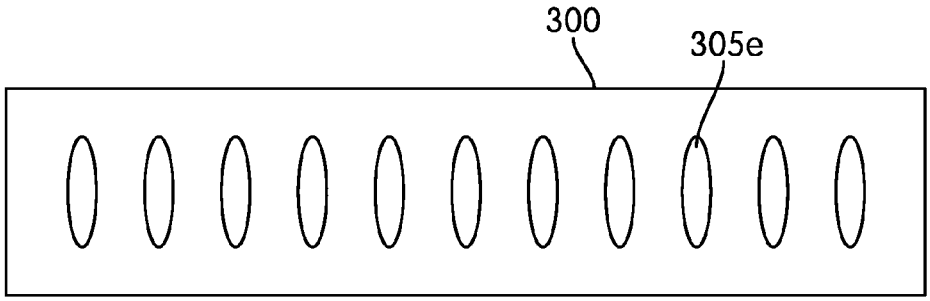

In some embodiments, as shown in FIG. 13, a plurality of the fold guides 305*e* may be die cut in the form of vertically oriented, elongated ovals. Incremental creases can be formed by folding along the oval's longer axis of symmetry, to achieve closure as the bag is repeatedly folded from the mouth toward the closed end of the package 10. FIG. 6 illustrates a package 10 that is a pillow style bag as shown in FIG. 5, but employing a single vertically oriented strip 300 having a plurality of die cut fold guides 305*e* shown in FIG. 13.

It will further be appreciated that in some embodiments, a strip 300 of malleable sheet material may be applied to both internal surfaces of the first and second side walls 100, 200 in substantial registration with one another. This may have the effect of decreasing the thickness of the strip 300 used, the retention force of the two strips working in tandem to provide a dead fold with sufficient resistance force to prevent spring-back of the packaging materials.

Manufacture of packages 10 in accordance with exemplary embodiments can generally be accomplished by conventional flexible film package manufacturing methods using rolls of thin film material. Exemplary embodiments employ additional steps of heat sealing the strip 300 of malleable sheet material to the thin film material. In embodiments in which the strip 300 is constructed of a metal foil or other conductive material, the strip 300 may stay hot for a longer period of time after the heat seal than the surrounding polymeric film. Accordingly, it may be desirable to cool the package 10 at various stages of its manufacture after heat sealing operations that include the strip 300 in order to avoid melting or shrinking and maintain a consistent level of quality.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A flexible package comprising:

a first package side wall having an external surface and an internal surface;

a second package side wall having an external surface and an internal surface, the second package side wall opposing the first package side wall such that the internal surfaces of the first and second package side walls face toward one another; and a strip of a malleable sheet material comprising a foil having a plurality of fold guides formed therein and attached to the first package side wall;

wherein an edge portion of the first package side wall is sealed to an edge portion of the second package side wall to form a seam, the first package side wall and the second package side wall further forming a mouth of the package, the strip of malleable sheet material oriented substantially horizontal with respect to the mouth of the package and wherein a portion of the strip of malleable sheet material extends into the seam between the edge portion of the first package side wall and the edge portion of the second package side wall, wherein a first fold guide is oriented substantially parallel with a length dimension of the strip and extends the length thereof and wherein a pair of second fold guides extending from a top strip edge to a bottom strip edge are oriented diagonally with respect to the strip, the package being configured to close by folding the first side wall along each of the first fold guide and the pair of second fold guides.

2. The flexible package of claim 1, wherein the first fold guide comprises a score extending linearly across the strip.

3. The flexible package of claim 1, wherein the first fold guide and the pair of second fold guides comprise a plurality of die cut apertures.

4. The flexible package of claim 1, comprising a plurality of strips of a malleable sheet material attached to the first package side wall.

5. The flexible package of claim 1, comprising a plurality of strips of a malleable sheet material, wherein a first strip is attached to the first package side wall and a second strip is attached to the second package side wall.

6. The flexible package of claim 1, wherein a nearest edge of the strip of the malleable sheet material to the mouth of the packaging is at least 0.375 in. from the mouth of the packaging.

7. The flexible package of claim 1, wherein the strip of the malleable sheet material comprises a polymer coated metallic foil and wherein the strip of the malleable sheet material is heat sealed to the internal surface of the first package side wall.

8. The flexible package of claim 1, wherein the package is selected from the group consisting of a pillow bag and a gusset bag.

9. The flexible package of claim 1, wherein the package is a gusset bag having a bottom portion intermediate the first package side wall and the second package sidewall.

10. The flexible package of claim 1, wherein the strip of the malleable sheet material comprises a metallic foil having a thickness of about 0.0025 inches to about 0.005 inches.

11. The flexible package of claim 1, wherein the strip of the malleable sheet material has a width of about 15 mm to about 75 mm.

12. The flexible package of claim 1, wherein the first fold guide is configured to form a crease that selectively retains the package in a closed position and the pair of second fold guides are configured to form creases that selectively retain the crease formed by the first fold guide.

13. A flexible package comprising:

a first package side wall having an external surface and an internal surface;

a second package side wall having an external surface and an internal surface, the second package side wall opposing the first package side wall such that the internal surfaces of the first and second package side walls face toward one another; and a strip of metallic foil attached to the first package side wall, extending from a first edge of the first package side wall to a second edge of the first package side wall;

wherein an edge portion of the first package side wall is sealed to an edge portion of the second package side wall to form a seam, the first package side wall and the second package side wall further forming a mouth of the package, wherein the package is a gusset bag having a bottom portion intermediate the first package side wall and the second package sidewall, wherein the strip of metallic foil is oriented substantially horizontally with respect to the mouth of the packaging, the strip of metallic foil having a plurality of fold guides formed therein, wherein a first fold guide comprising a score extending linearly across the strip of the metallic foil is oriented substantially parallel with a length dimension of the strip and extends the length thereof and wherein a pair of second fold guides comprising a score extending from a top strip edge to a bottom strip edge are oriented diagonally with respect to the strip, the package being configured to close by folding the first side wall along each of the first fold guide and the pair of second fold guides.

14. The flexible package of claim 13, wherein the metallic foil comprises a polymer coated metallic foil and wherein the polymer coated metallic foil is heat sealed to the internal surface of the first package side wall.

15. The flexible package of claim 14, comprising a plurality of strips of polymer coated metallic foil material, at least one of which is attached to the first package sidewall, wherein the strips are vertically separated from one another.

16. A flexible package comprising:

a first package side wall having an external surface and an internal surface;

a second package side wall having an external surface and an internal surface, the second package side wall opposing the first package side wall such that the internal surfaces of the first and second package side walls face toward one another; and a strip of a polymer coated metallic foil heat sealed to a surface of the first package side wall, the foil extending from a first edge of the first package side wall to a second edge of the first package side wall, the foil having a thickness in the range of about 0.003 inches to about 0.005 inches;

wherein an edge portion of the first package side wall is sealed to an edge portion of the second package side wall to form a seam, the first package side wall and the second package side wall further forming a mouth of the package, wherein the strip of foil is oriented substantially horizontally with respect to the mouth of the package, the foil having a first fold guide formed therein comprising a score extending linearly substantially parallel to the mouth of the package and a pair of second fold guides formed therein comprising scores extending diagonally with respect to the mouth of the package from a top strip edge to a bottom strip edge, the first fold guide forming a crease configured to selectively retain the package in a closed position and the pair of second fold guides forming creases configured to selectively retain the package in the closed position from the first fold guide.

17. The flexible package of claim 16, wherein the score comprises a series of perforations.

* * * * *